United States Patent [19]

Mohon et al.

[11] 3,945,133

[45] Mar. 23, 1976

[54] WEAPONS TRAINING SIMULATOR UTILIZING POLARIZED LIGHT

[75] Inventors: Windell N. Mohon, Winter Park; George Derderian, Maitland; Denis R. Breglia, Altamonte Springs, all of Fla.

[73] Assignee: The United States of America as represented by the Secretary of the Navy, Washington, D.C.

[22] Filed: June 20, 1975

[21] Appl. No.: 588,738

[52] U.S. Cl. ..... 35/25

[51] Int. Cl.[2] ..... F41G 3/26

[58] Field of Search ..... 35/25; 273/101.1, 101.2

[56] References Cited

UNITED STATES PATENTS

| | | | |
|---|---|---|---|
| 2,162,707 | 6/1939 | Fischer | 35/25 |
| 2,418,512 | 4/1947 | Johnson | 35/25 |
| 2,516,319 | 7/1950 | Hooker | 35/25 |
| 2,662,305 | 12/1953 | Alric | 35/25 |
| 2,795,057 | 6/1957 | Sohn | 35/25 |
| 3,798,796 | 3/1974 | Stauff et al. | 35/25 |
| 3,904,204 | 9/1975 | Yokoi | 35/25 |

*Primary Examiner*—Wm. H. Grieb

*Attorney, Agent, or Firm*—Richard S. Sciascia; John W. Pease

[57] ABSTRACT

A weapons training simulator in which a multilayer composite movie film formed of a normal film for projecting a non-polarized image of target and background and a polarized film for projecting a polarized target image is utilized in a projector to project the polarized and non-polarized images on a non-depolarizing screen and in which a weapons mounted polarized light sensor circuit is provided to indicate target hit or miss as the weapon is aimed and fired. The invention also contemplates intentional non-registration of the normal and polarized films by a number of frames selected to represent the correct target lead to properly hit the moving target.

8 Claims, 6 Drawing Figures

WEAPONS TRAINING SIMULATOR UTILIZING POLARIZED LIGHT

BACKGROUND OF THE INVENTION

The invention relates to the arts of optics and electronics in the field of simulation and has particular reference to gunnery training via simulation and without the requirement of live ammunition.

A past and continuing need exists to train military in simulated combat conditions in a safe, low-cost manner without the requirement of firing live ammunition.

Recently simulators have been developed utilizing lasers and target associated detectors in weapon fire simulation systems. Also utilized have been lasers, retroreflective targets and weapon mounted laser beam detectors in weapon fire simulation systems.

SUMMARY OF THE INVENTION

The subject invention is directed to the advantages of simulating via movie film a variety of targets in moving action with provision for real time feedback to the trainee of his performance and at minimum cost and complexity in relation to film preparation and projecting means therefor. In this respect the invention comprises the employment of a composite of film layers, one layer constituting a normal film for projecting a background and moving target and a polarized film for projecting on a common non-depolarizing screen a polarized target, the films being indexed for non-registration to provie a desired lead in the polarized target. The invention further includes a polarizing rotor for developing distinguishing direct current and alternating current miss and hit indicator signals, corresponding respectively to light from the normal film projection and the polarized film projection, together with an electrical circuit and hit indicator means responsive to the alternating current to indicate a hit.

DESCRIPTION OF THE PREFERRED EMBODIMENT

Figure 1:
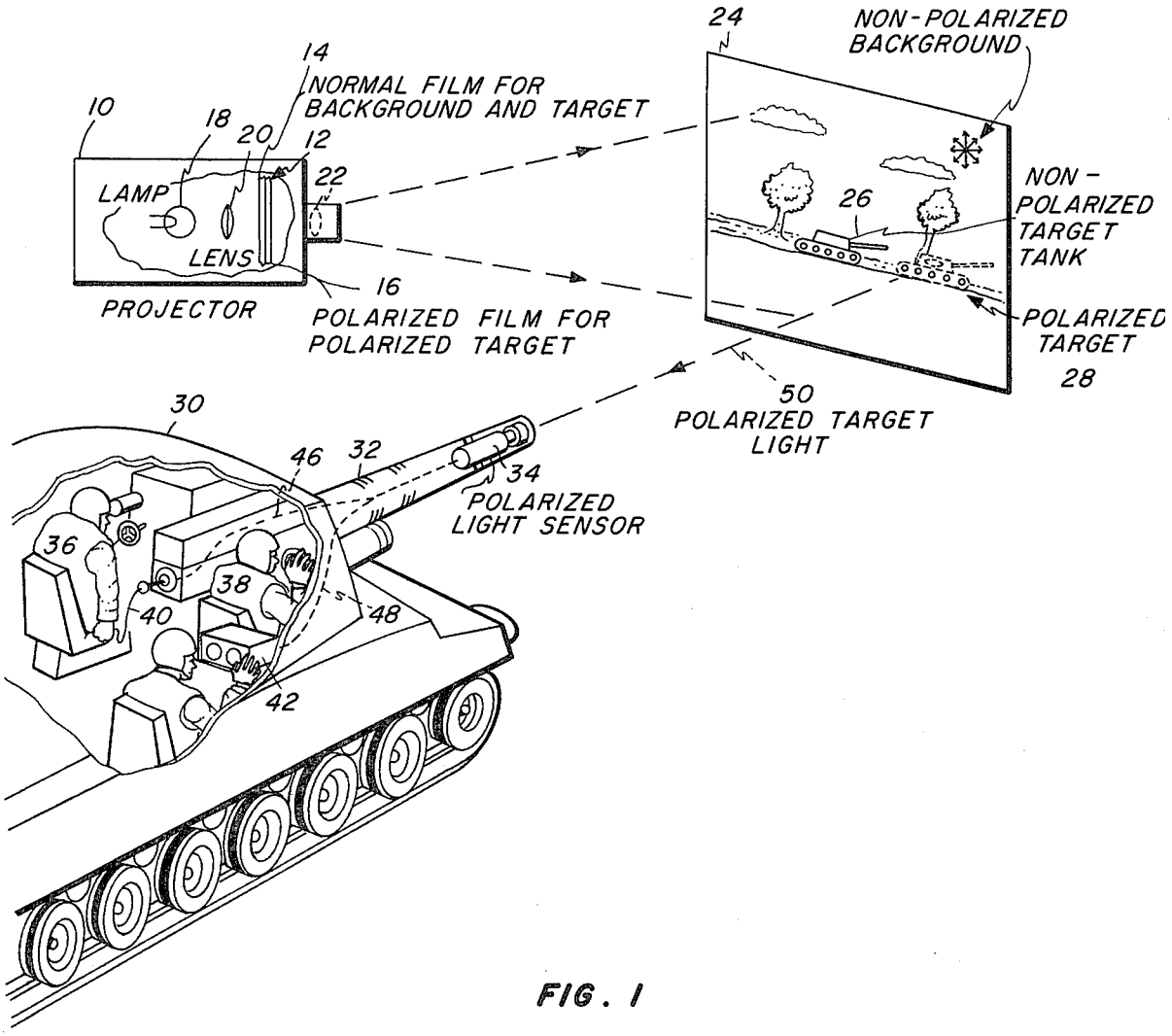
FIG. 1 is a schematic view of a gunnery training simulator embodying the present invention.

Referring to the drawings in FIG. 1 is shown schematically a gunnery training simulator incorporating the invention. The simulator comprises a projector 10 with composite film 12 of respective layers of normal film 14 and polarized film 16. A lamp 18 and lens system indicated by lenses 20 and 22 project a composite of non-polarized and polarized images on a non-depolarizing screen 24. The normal film projects a non-polarized visible image of background, including clouds, roadway, trees, and a target tank 26, all indicated. The polarized, vectograph type, film 16 projects a non-visible polarized tank target 28 in a lead position in relation to the visible tank 26, the lead distance being made to correspond to a proper aiming lead to hit the moving target tank 26. How the films are made and developed to provide the above defined relationships will be described in detail hereinafter in relation to FIGS. 2A and 2B.

Continuing with FIG. 1, a weapon used in the gunnery training is shown as a tank 30 having a barrel 32 in which is mounted a polarized light sensor 34. Any weapon can be used and the polarized light sensor mounted on the weapon such that it will be directed to receive light from the area of the target at which the gun is aimed. For example, the invention can be used with the conventional M-16 military rifle.

In the example given in FIG. 1, as the gun is aimed for direct fire maneuvers the barrel is moved in azimuth and elevation by the personnel indicated at 36 and 38. The gun is fired in simulation by individual 36 pulling the lanyard cord 40 which energizes the polarized light sensor 34 such that it will send a hit signal to a hit indicator cabinet 42 which is viewed by the instructor. The hit indicator can be visual or audio, a counter, bell, light or any suitable means. Further details on the light sensor and hit indicator will be given hereinafter in relation to a description of FIG. 4. The lanyard 40 operates a trigger switch, indicated at 44 in FIG. 4, and is hence shown connected as by dotted line 46 to the light sensor 34. Also connected to the light sensor 34, as by line 48, is the hit indicator cabinet 42.

In operation the tank 30 is aimed to direct fire at the visual tank 26 on the screen 24 with proper lead for given conditions to actually be directed at the invisible polarized tank target 28 which is also projected on the screen 24. When the gun is properly trained a polarized light signal, indicated at 50, will impinge upon a detector 62 (FIG. 4) inside the sensor 34 (FIG. 1) to trigger a hit indicator in the cabinet 42. The polarized light sensor 34 will not activate the hit indicator unless the gun is in triggered condition by having had the lanyard cord pulled.

Figure 2A:
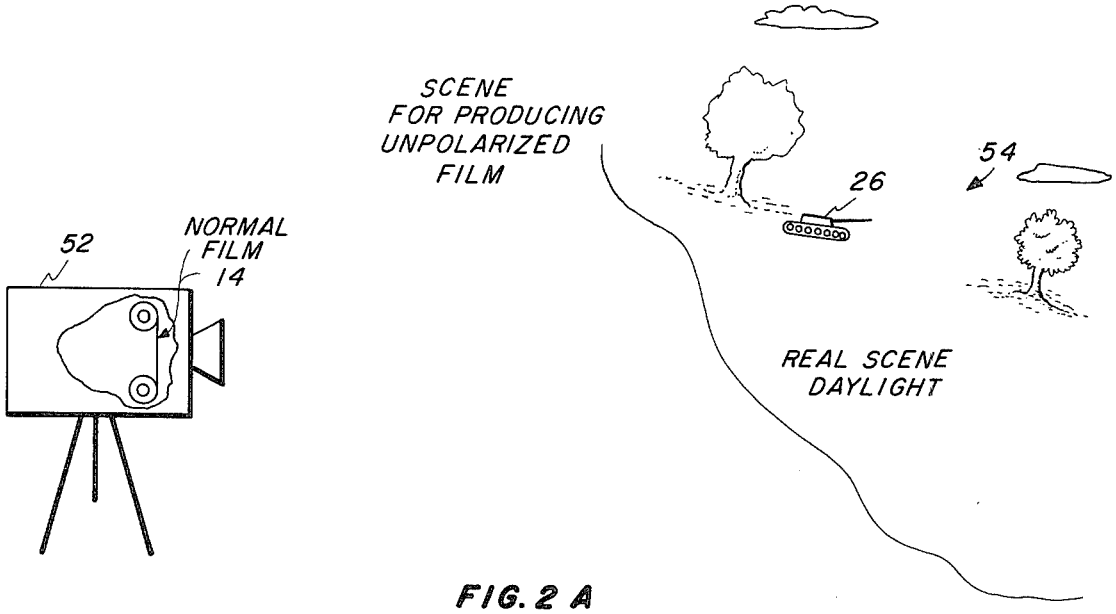
FIGS. 2A and 2B are schematic views provided to aid in explaining the manner of developing a multilayer film employed in the apparatus of FIG. 1.

Referring to FIG. 2A, it will be noted that a camera 52 is loaded with a normal film, indicated at 14 in FIG. 1, and hence indicated at 14 in FIG. 2A. The camera 52 is directed at a real life daylight scene indicated generally at 54 and including the same clouds, trees, road and moving tank 26 as shown on the screen 24 in FIG. 1. The scene 54 thus provides the means for producing a normal film of the visible background and tank image to be projected as a moving picture film presentation on the screen 24.

Figure 2B:
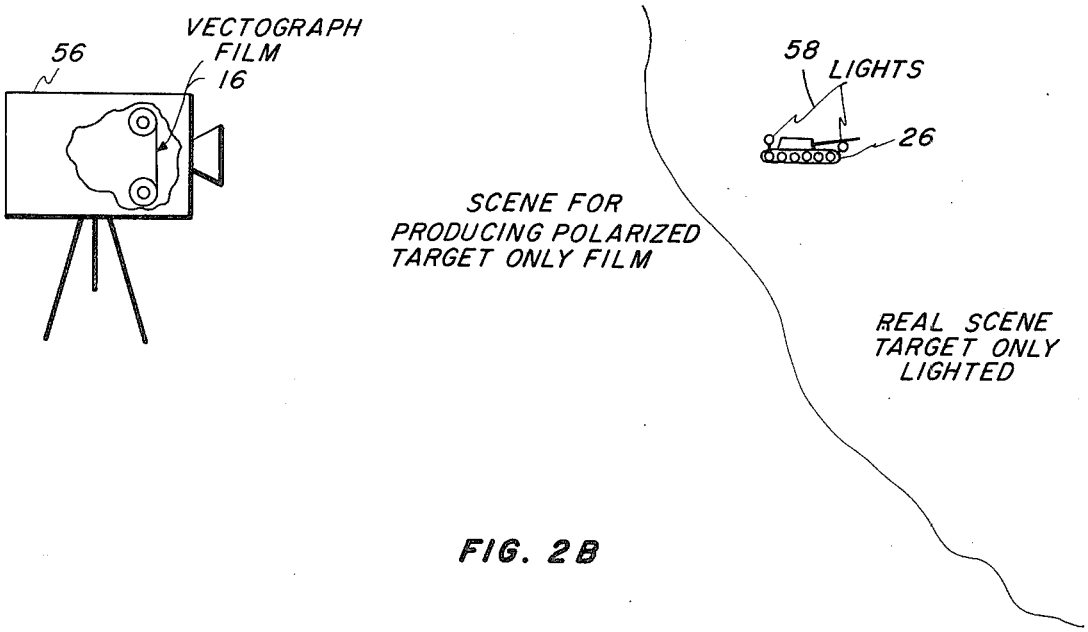

In FIG. 2B is shown a camera identified as 56 for convenience, but which could be the same camera as 52, but in which is placed a roll of vectograph type film 16. This latter camera 56 is directed at the same scene including the tank 26 moving on the same road at the same speed except that the film is exposed at night and lights 58 are provided such that the film records only the tank and the recording is in a polarized image of the tank such that one is then able to project a polarized target image 28 (FIG. 1) on the screen 24.

However, to get the composite scene indicated in FIG. 1 on screen 24, the two layers of film are cemented together as a composite two layer film 12. In doing so, however, to provide the proper lead in the position of the polarized target tank in relation to the visible target tank the film frames of the polarized film are advanced to a desired degree of non-registration to provide the desired lead distance for the particular weapon and ammunition being used.

Figure 3A:
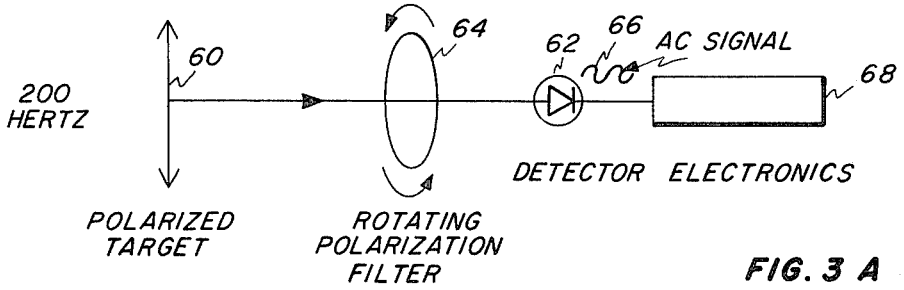
FIGS. 3A and 3B are diagrammatic views provided to illustrate the means and manner of obtaining alternating current and direct current output signals respectively from inputs of polarized and unpolarized light.
Figure 3B:
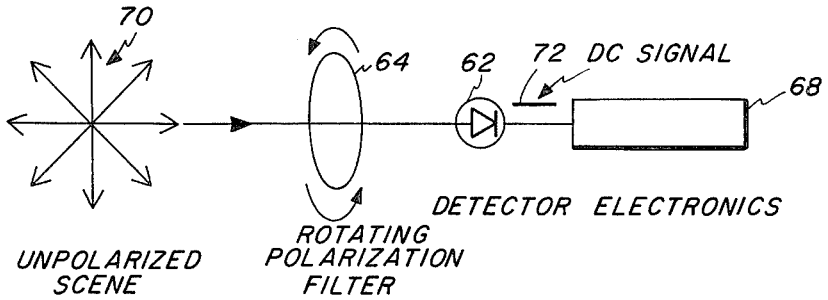

Referring to FIGS. 3A and 3B, the schematic views shown therein illustrate how an alternating current is obtained from polarized target light, as for example that which comes from the polarized tank image 28 on screen 24, and how a direct current is obtained from the non-polarized light of the background and tank area of the visible non-polarized image projected on the screen 24.

In FIG. 3A light from a polarized target is indicated by the vertical double headed arrow 60. Directed to receive the polarized light is a light detector such as photoelectric diode 62, and in the path of light between the detector 62 and polarized light source is positioned a rotating polarization filter 64 which passes polarized light in increasing and decreasing amounts as the filter is rotated such that the output signal from the detector 62 is an alternating current (a.c.) signal as indicated at 66. This filter is rotated at 200 hertz such that a band-pass filter, as will be described hereinafter in relation to FIG. 4, may be used to avoid a development of an a.c. current output from detector 62 in swing of the weapon and resultant variation in the light intensity from different background areas. FIG. 3A thus illustrates the development of a.c. current as an output to an electronic indicator circuit represented by the block 68, and which would correspond to the sensor 34 and hit indicator circuits 42 shown in FIG. 4.

In FIG. 3B there is shown the same arrangement of elements 62, 64, and 68 except that the source of light is unpolarized as represented by an infinite number of arrows passing through a common point and generally indicated at 70. This unpolarized light source represents the unpolarized light on the screen 24 and thus includes the background scene and the non-polarized visible tank 26. In this case, since the source light is represented by an infinite number of arrows, then rotating the polarization filter does not provide the necessary spaced increase and decrease in output current necessary to produce an a.c. signal and hence the output, from the detector 62 to the electronic circuit represented by the block 68, is a direct current signal indicated by a straight line at 72. We have thus provided a means for obtaining a d.c. signal responsive to light from an unpolarized source and an a.c. signal from light from a polarized target source. We have now to provide a suitable circuit to trigger a hit indicator only responsive to an a.c. signal, a d.c. signal being indicative of a miss.

Figure 4:
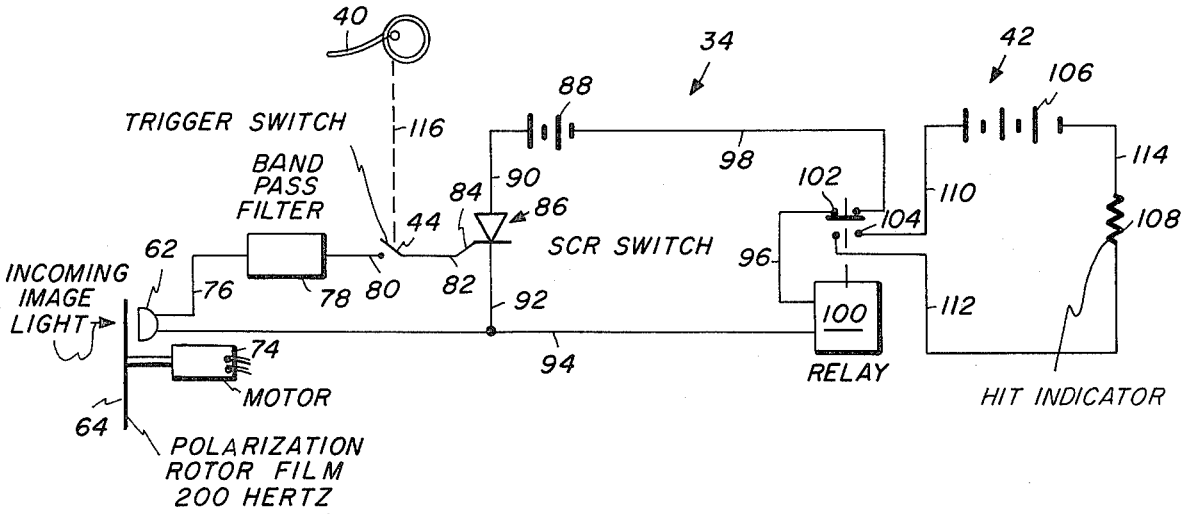
FIG. 4 is a schematic view of a suitable electrical circuit for a weapon mounted signal receiver and hit indicator system employed in the apparatus of FIG. 1.

In FIG. 4 one such suitable circuit is shown in relation to the detector 62 and the rotatable polarization filter 64, the latter being driven by a motor 74. The resulting output signal from detector 62 is passed on line 76 to a band pass filter 78 of suitable value to eliminate direct current signals from the normal film scene and any alternating current signals which could be developed by swing of the weapon and which would be relatively low frequency compared to the selected filter frequency. Thus, one suitable filter 78 would be a BCS Associates, Inc. model ATF 76-B1, which is tuned to pass only a.c. signals at 200 hertz ±3%, corresponding to the rotated speed of the polarization film 64. The signal output of filter 78 is passed on lines 80 and 82 via trigger switch 44 to the gate 84 of an SCR 86 which is the switch means for a relay circuit having the necessary switching elements to control a load circuit of which the hit indicator means forms the load. In particular, the positive side of a d.c. source, battery 88, is connected via a line 90 to the input side of the SCR 86. The output side of the SCR 86 is connected via lines 92, 94, 96 and 98 through a switching relay 100 and through one set of normally closed contacts 102 of relay 100 back to the negative side of the battery 88. A second set of normally open contacts 104 of the relay 100 is employed to close and open the indicator circuit which includes a battery 106 connected in series with the contacts 104 and a hit indicator, represented by the resistor 108, via the lines 110, 112 and 114. It is to be understood that the hit indicator can be any suitable hit indicating device as for example, an alarm, a light, a graph recorder or a counter. A dotted line 116 represents the mechanical connection of the lanyard 40 to the trigger switch 44.

In operation, when the switch 44 is open the system is inoperative. When switch 44 is closed and the weapon is not properly aimed to provide a polarized incoming image light, i.e., the gun is not aimed at the polarized tank image 28, then the d.c. input from a line 76 will be blocked by band pass filter 78 and there is no activation of the circuit to energize the hit indicator 108. However, when the weapon is properly aimed at the polarized tank target 28, i.e., at the position of that image because the image itself is invisible, thus providing proper target lead, then the incoming image light is polarized, an a.c. output signal is passed through filter 78 and through closed trigger switch 44 to activate the SCR 86 to conducting condition. The d.c. current from battery 88 energizes switch relay 100 to close contacts 104 and open contacts 102. Opening contacts 102 provides the means for interrupting the flow of current through the SCR 86, thus turning it off, to prepare for the next sequential action. Closing the contacts 104 passes current to the hit indicator 108 to indicate or record a hit in accordance with the form of hit indicator selected.

What is claimed is:

1. A polarizing type gunnery training simulator comprising a. a projector;

b. a composite specially polarized movie film for said projector comprising layers respectively of normal non-polarized film taken of a scene including background and target areas and a polarizing type film taken of the target area only of the scene;

c. said normal film having recorded said entire scene during the daytime, and said polarizing type film having recorded said targets at night with only said targets illuminated to provide a film of linearly polarized target areas upon exposure;

d. a non-polarizing screen upon which to display, via said projector, the unpolarized entire scene and the linearly polarized target area of said scene; and e. a polarized light sensor unit and means for attaching said unit to a weapon to provide hit indication when said weapon is aimed at said polarized target area, and no hit indication when said weapon is aimed at said non-polarized background scene.

2. Apparatus according to claim 1 said films being assembled in a desired degree of non-registration to provide a polarized target lead corresponding to selected problem vehicle speed.

3. Apparatus according to claim 1 wherein said sensor unit comprises a. a light wave detector;

b. a rotatable polarization type filter positioned between said screen and light detector;

c. means for rotating said filter to pass to said detector variable light value for polarized light and continuous light value for non-polarized light to produce respectively alternating and direct current outputs from said detector; and d. an amplifying and indicating electrical circuit for detection of alternating current indicative of target hit and direct current indicative of target miss.

4. Apparatus according to claim 2 wherein said sensor unit comprises a. a light wave detector;

b. a rotatable polarization type filter positioned between said screen and light detector;

c. means for rotating said filter to pass said detector variable light value for polarized light and continuous light value for non-polarized light to produce respectively alternating and direct current outputs from said detector; and d. an amplifying and indicating electrical circuit for detection of alternating current indicative of target hit and direct current indicative of target miss.

5. Apparatus according to claim 3 said electrical circuit including a direct current meter to distinguish between direct and alternating current.

6. Apparatus according to claim 2 said electrical circuit including an amplifier, a switching relay biased to open switch condition and actuable to closed switch position when alternating current is applied to said relay, and indicator means for connecting through said switch to a source of voltage potential to provide a signal indicative of target hit.

7. Apparatus according to claim 4 said electrical circuit including a direct current meter to distinguish between direct and alternating current.

8. Apparatus according to claim 4 said electrical circuit including an amplifier, a switching relay biased to open switch condition and actuable to closed switch position when alternating current is applied to said relay, and indicator means for connecting through said switch to a source of voltage potential to provide a signal indicative of target hit.

* * * * *